US007975850B2

(12) United States Patent
Tucker

(10) Patent No.: US 7,975,850 B2
(45) Date of Patent: Jul. 12, 2011

(54) APPARATUS AND METHOD FOR SEPARATING SAND FROM A MANURE SLURRY

(76) Inventor: Randall L. Tucker, Findlay, OH (US)

( * ) Notice: Subject to any disclaimer, the term of this patent is extended or adjusted under 35 U.S.C. 154(b) by 0 days.

(21) Appl. No.: 12/530,226

(22) PCT Filed: Mar. 5, 2008

(86) PCT No.: PCT/US2008/055917
§ 371 (c)(1),
(2), (4) Date: Oct. 21, 2009

(87) PCT Pub. No.: WO2008/109676
PCT Pub. Date: Sep. 12, 2008

(65) Prior Publication Data

US 2010/0044279 A1 Feb. 25, 2010

(51) Int. Cl.
*B03B 9/00* (2006.01)

(52) U.S. Cl. ..... 209/10; 209/13; 209/483; 209/390

(58) Field of Classification Search ..... 209/10, 209/13, 483, 490, 491, 499, 930
See application file for complete search history.

(56) References Cited

U.S. PATENT DOCUMENTS

| | | | | |
|---|---|---|---|---|
| 3,875,319 | A * | 4/1975 | Seckler et al. | 426/431 |
| 5,287,975 | A * | 2/1994 | Chumley et al. | 209/3 |
| 5,476,177 | A * | 12/1995 | Schmidt | 209/13 |
| 5,720,393 | A * | 2/1998 | Wedel et al. | 209/13 |
| 6,227,379 | B1 * | 5/2001 | Nesseth | 210/393 |
| 6,764,596 | B2 * | 7/2004 | Tucker | 210/162 |
| 7,699,177 | B2 * | 4/2010 | Craig | 209/159 |
| 2002/0046712 | A1 * | 4/2002 | Tripp et al. | 119/450 |
| 2006/0273048 | A1 | 12/2006 | Doyle et al. | |

FOREIGN PATENT DOCUMENTS

GB 531822 1/1941

OTHER PUBLICATIONS

PCT/US2008/055917 International Search Report, mailed Aug. 1, 2008.

* cited by examiner

*Primary Examiner* — Stefanos Karmis
*Assistant Examiner* — Terrell H Matthews

(57) ABSTRACT

A separation apparatus (A) separates particulates such as sand from a slurry of water/sand/manure. Particularly, passage (20) receives the slurry and injectors (40) assist the slurry over ramp (42) and aid in separating the sand and organic material from the slurry. The sand proceeds through a discharge (44) and preferably a counter flow of sanitizer from sterilizing passage (60) proceeds through the sand. Cleaned and sanitized sand is temporarily stored in a collector (62).

17 Claims, 2 Drawing Sheets

APPARATUS AND METHOD FOR SEPARATING SAND FROM A MANURE SLURRY

BACKGROUND OF THE INVENTION

This application relates to an apparatus and method of separating materials, particularly for separating sand from a manure slurry. It will be appreciated, however, that the application may find application in similar environments and applications.

There is an increased emphasis on effectively and efficiently treating manure generated by farming operations. For example, large scale or mega-dairy farms have come under increased scrutiny with respect to the large amount of generated organic waste or manure and the impact on the environment. In the past, the manure has been washed from the barn and the resultant slurry spread over farm fields where it acts as a fertilizer. However, organic loading on the farm fields must be carefully regulated, particularly during extended periods of cold weather where the slurry does not efficiently or effectively break down quickly. This can lead to undesired runoff of the organics into the watershed. As will be appreciated, small streams cannot handle large amounts of organics and, likewise, treatment plants are not as prevalent in rural communities. This adversely contributes to organic loading issues in larger streams, rivers, and lakes.

Regulations, for example, promote use of lagoons or settling ponds in an effort to control runoff. Unfortunately, a large amount of the manure slurry is comprised of particulate material (e.g., sand) that settles from the slurry and undesirably fills the settling ponds. Likewise, direct treatment of the manure slurry still encounters issues relating to the particulate sand and that the sand adds to weight, disposal, and treatment issues.

Thus, a need exists for effective removal of particulate material from a manure slurry, including dewatering and sanitizing of the particulate material, so that the removed material can be recycled or used for other purposes.

SUMMARY OF THE INVENTION

An apparatus for separating particulate material such as sand from a slurry of manure is disclosed. The apparatus includes a sluice passageway dimensioned to a predetermined depth. A discharge opening communicates with the passageway through which the particulate material is removed from the passageway.

The apparatus includes means for collecting the particulate material from the opening.

The apparatus may also include a counter flow of water for cleaning the collected particulate material.

A valve is provided in the discharge opening, responsive to a sensor, for selectively opening and closing to thereby discharge and temporarily store the collected particulate material.

The collecting means includes a ramp mounted in the sluice passageway with a leading end upstream of a trailing end disposed at an elevated level relative to the leading end, and the discharge opening is disposed adjacent the trailing end.

The apparatus preferably includes means for injecting a sanitizer into the collected particulate materials downward flow.

Injectors spaced along the passageway urge the manure sand slurry along the passageway toward the discharge opening.

A process of separating sand from a manure slurry that includes sand, organics, and water, includes directing a manure slurry into a sluice having a predetermined depth, injecting cleaner water at spaced locations along the sluice to urge the slurry along the sluice and periodically separate organics from the slurry, and removing organics from a lower strata of the sluice leaving the sand.

One advantage of this disclosure relates to the ability to effectively remove particulate material from a manure slurry.

Another advantage resides in easily dewatering and sanitizing the particulate material for re-use.

Still other advantages and benefits relating to this disclosure will become apparent from reading and understanding the following detailed description.

DETAILED DESCRIPTION

Figure 1:
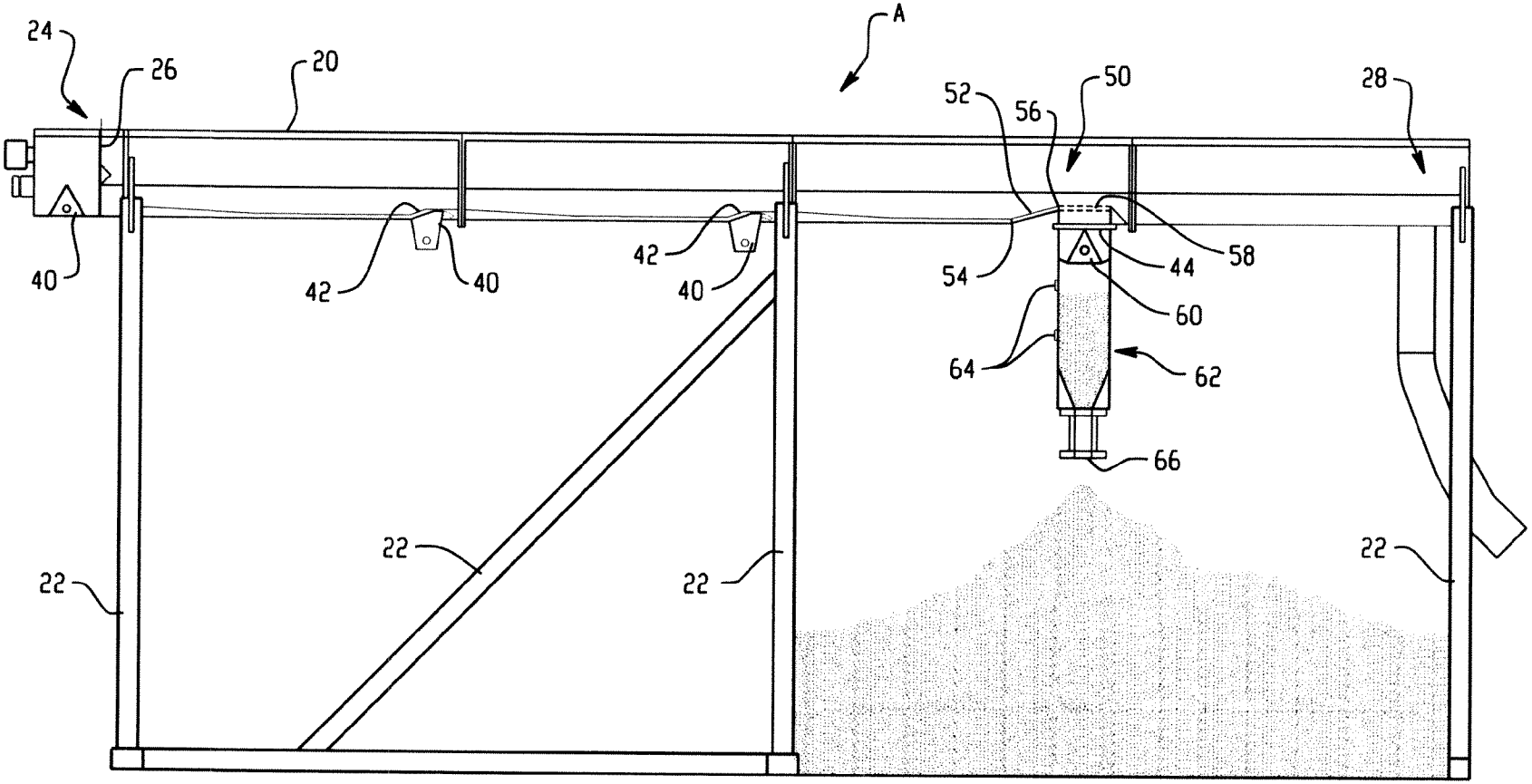
FIG. 1 is an elevational view of a first preferred embodiment of the present disclosure.
Figure 5:
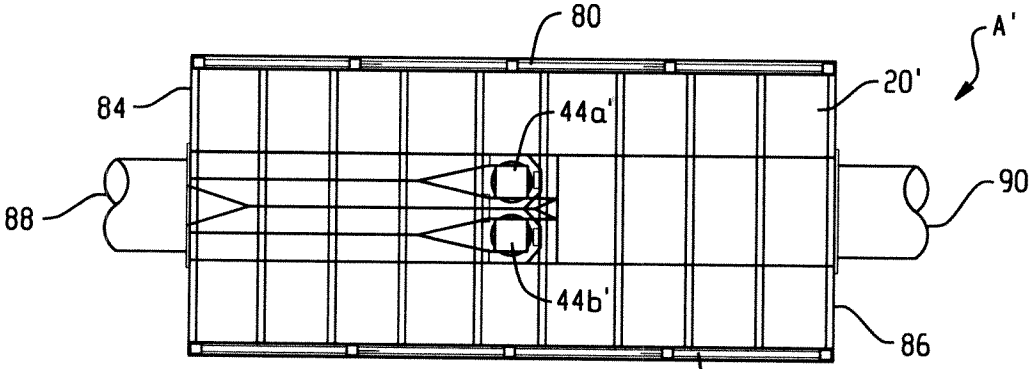
FIG. 5 is an overhead plan view of the second embodiment.
Figure 2:
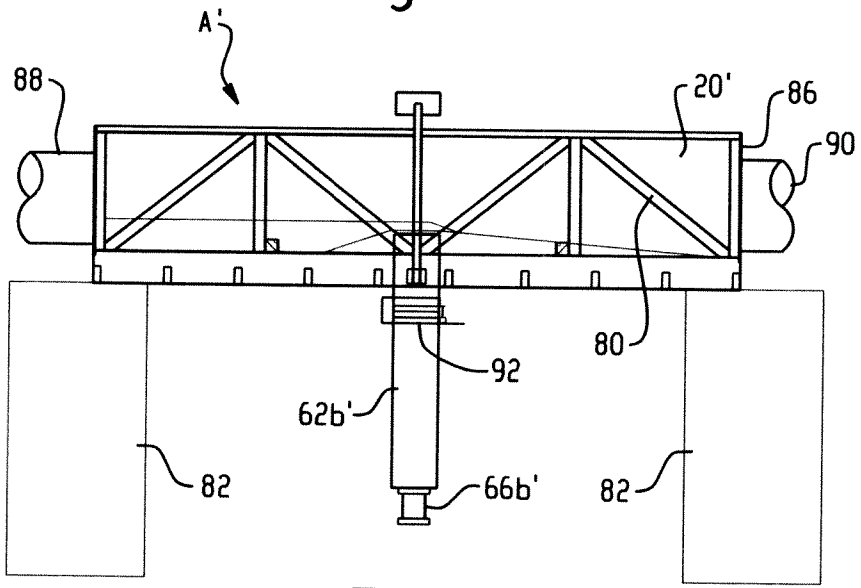
FIG. 2 is an elevational view of a second preferred embodiment of the present invention.
Figure 3:
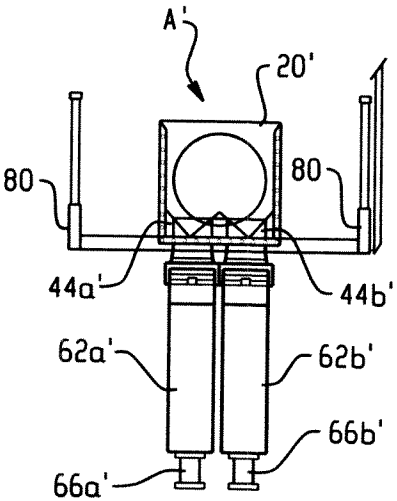
FIGS. 3 and 4 are end views taken generally from the left-hand and right-hand sides of FIG. 2.
Figure 4:
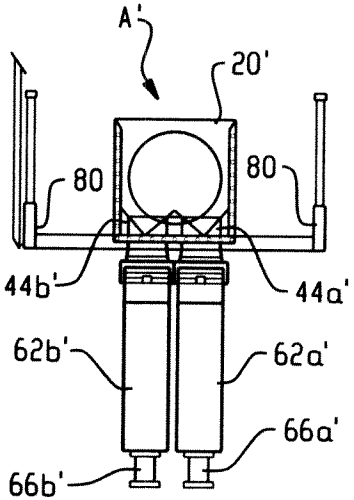

Turning initially to FIG. 1, there is shown a separation apparatus A for treating a manure slurry, more specifically separating sand from a flow of water, sand, and manure. Preferably a channel or passage 20 can be elevated by support members 22 spaced therealong or by other structural means. The passage may be open along its length and is fed with a manure slurry from a pumped source or gravity flow (not shown) at a first end or inlet 24 where a weir 26 establishes a depth and velocity of the slurry in the sluice as the slurry extends toward a second end or outlet 28. As illustrated, the depth of the slurry in the passage typically does not extend over the full height of the passage. The slurry is assisted toward the outlet by one or more injectors 40 that may be spaced along the length of the passage, or may form a part of miniature ramps 42. In this manner, as the flow of the sand/water/manure slurry moves along the sluice, water is injected into the slurry at the downstream end of each miniature ramp. This causes the sand to drop through clean water from the injector which cleans the organics, etc., from the sand and moves the lighter organic material into an upper strata of the slurry.

When the slurry reaches an opening or discharge 44 in the passage, the particulate material (sand in this instance) is removed from the passage. Particularly, the discharge opening extends through a lower surface of the passage to effectively remove the heavier weight particulate material from the slurry. In some instances, a simple opening in the passage is sufficient. In other instances, incorporating the technology of commonly owned U.S. Pat. Nos. 6,042,733; 6,348,199; and 6,764,596 may be used, the details of which are expressly incorporated herein by reference. Particularly, one or more collectors 50 each including ramped surface 52 has a first or leading end 54 at a lower elevation than a second or trailing end 56. The discharge opening 44 is preferably located adjacent the second end, for example, adjacent an apex of the ramp. The collector typically includes a downstream surface that angles more sharply downwardly from the apex resulting in a lower velocity such that the heavier particulate materials fall though the discharge opening in the collector.

A prescreen 58 may be located over the discharge opening in order to prevent clumps of material or large particulates of a certain size from passing through to the discharge opening. Likewise, manure and dirty water continues past the discharge opening 44 to outlet 28 where it may be separately treated in any desirable manner. The sand, on the other hand, proceeds through the discharge opening. A reverse flow of a sanitizer such as a diluted chlorine solution is introduced in a counter-flow from a sterilizing passage 60 (referred to as a doghouse because of its cross-sectional shape), although it will be appreciated that other injection devices or solutions could be used to kill bacteria. This adds a counter-flow that proceeds upwardly toward the discharge opening and keeps the dirty water and organics from entering the discharge opening.

The cleaned and sanitized sand is preferably temporarily stored in a vertical column collector 62. By temporarily storing the sand in the vertical column collector 62 the sand settles to the bottom, of the vertical collector and the water rises toward the upper regions where a portion is ejected with the upwelling from the counters flow. In this manner, the sand is cleaned or washed, sanitized, and only contains approximately five to seven percent (5-7%) water. Sensors 64 associated with the vertical column collector determine a predetermined height of collected sand, or detect a predetermined weight of the sand to selectively open a discharge valve 66 where the sand drops for removal.

By temporarily storing the sand in the vertical column collector, the sand is partially de-watered as the falling sand displaces the water as the vertical collector is filled. The level or height of the column of collected sand determines the dryness of the sand that is discharged from the vertical column collector.

As shown in FIGS. 2-5, a second preferred embodiment of the separator is shown. For ease of illustration and description, like components are identified by the same numeral with a primed suffix, and new numerals are added to identify new components or features. A catwalk 80 supports the passage 20', and the catwalk is in turn supported at opposite ends by columns 82. The passage includes end faces 84, 86 at the inlet 22 and outlet 24, respectively, that connect to inlet and outlet pipes 88, 90 (ranging for example in size from six (6") to thirty-six (36") inches in diameter). A pair of discharge openings 44*a'*, 44*b'* are provided in the passage which may be provided in a ramp collector 50' of the type described in the commonly owned patents. Thus, a pair of vertical column collectors 62*a'*, 62*b'* temporarily store the collected particulate material, i.e., sand, where the sand has been sanitized at sanitizer station 92 and partially dewatered by settlement in the columns. Discharge valves 66' are provided at lower ends of the vertical column collectors and are selectively opened and closed in response to sensors such as load cells that monitor the weight of the collected sand. Multiples of the discharge openings in the same sluice and related equipment could be utilized to capture additional like sands or dissimilar gravel or other gradients.

The invention has been described with respect to preferred embodiments. Alterations and modifications fall within various aspects of the present disclosure. The disclosure should not be limited by such changes but rather only limited by the accompanying claims.

Having thus described the invention, it is now claimed:

1. An apparatus for separating particulate material such as sand from an associated slurry of manure, the apparatus comprising:

a sluice passageway dimensioned to receive the associated slurry at a predetermined depth;

an opening through which associated particulate material from the slurry exits the passageway;

injectors spaced along the passageway for urging the associated manure slurry along the passageway toward the opening, and a ramp disposed immediately upstream of at least one of the injectors for cleaning organics from the associated collected particulate material; and a collector that receives the associated particulate material from the opening.

2. The apparatus of claim 1 wherein the collector includes a counter flow passage for cleaning the associated collected particulate material.

3. The apparatus of claim 2 wherein the counter flow includes a discharge opening that selectively discharges predetermined quantities of the associated collected particulate material.

4. The apparatus of claim 3 wherein the discharge opening includes a sensor for monitoring an amount of the associated collected particulate material.

5. The apparatus of claim 4 wherein the discharge opening includes a valve, responsive to the sensor, that selectively opens and closes to thereby discharge and temporarily store the associated collected particulate material.

6. The apparatus of claim 1 wherein the collector includes a ramp mounted in the sluice passageway with a leading end upstream of a trailing end disposed at an elevated level relative to the leading end.

7. The apparatus of claim 6 wherein the opening is disposed adjacent the trailing end.

8. The apparatus of claim 7 further comprising a prescreen over the opening for preventing larger dimension materials from entering the opening.

9. An apparatus for separating particulate material such as sand from an associated slurry of manure, the apparatus comprising:

a sluice passageway dimensioned to receive the associated slurry at a predetermined depth;

an opening through which associated particulate material from the slurry exits the passageway;

a collector that receives the associated particulate material from the opening;

a first injector spaced along the passageway for urging the associated slurry along the passageway toward the opening; and a second injector that introduces a sanitizer to the associated collected particulate material passing through the collector.

10. A process of separating sand from a manure slurry that includes sand, organics, and water, comprising:

directing a manure slurry into a sluice having a predetermined depth;

injecting clean water at spaced locations along the sluice to urge the slurry along the sluice and periodically separate organics from the slurry;

removing sand from a lower stratum of the sluice;

sanitizing the removed sand; and dewatering the removed sand after the sanitizing step.

11. The process of claim 10 further comprising providing a counterflow of water through the sand as the sand is removed from the sluice.

12. The process of claim 10 including passing the slurry over a ramp prior to removing the sand from the slurry.

13. The process of claim 10 further comprising discharging the dewatered sand once a predetermined amount of sand is collected.

14. The process of claim 13 wherein the sand discharging step includes weighing the collected sand so that discharging occurs in response to a predetermined weight.

15. The apparatus of claim 1 further comprising water injectors introducing water to urge the slurry along a path of the sluice.

16. The apparatus of claim 15 wherein an inlet of the sluice is spaced above an outlet to provide a gravity feed arrangement that urges the slurry from the inlet to the outlet.

17. The process of claim 10 further comprising positioning an inlet to the sluice at a height above an outlet of the sluice to urge slurry flow from the sluice inlet to the sluice outlet.

* * * * *